US008156921B2

(12) United States Patent
Meacock

(10) Patent No.: US 8,156,921 B2
(45) Date of Patent: Apr. 17, 2012

(54) VALVE OPENING ARRANGEMENT AND METHOD

(75) Inventor: William A. Meacock, Carlisle, PA (US)

(73) Assignee: Mack Trucks, Inc., Greensboro, NC (US)

( * ) Notice: Subject to any disclaimer, the term of this patent is extended or adjusted under 35 U.S.C. 154(b) by 287 days.

(21) Appl. No.: 12/518,906

(22) PCT Filed: Dec. 12, 2006

(86) PCT No.: PCT/US2006/061910

§ 371 (c)(1),
(2), (4) Date: Jun. 12, 2009

(87) PCT Pub. No.: WO2008/073123

PCT Pub. Date: Jun. 19, 2008

(65) Prior Publication Data

US 2009/0266317 A1 Oct. 29, 2009

(51) Int. Cl.
*F02D 13/04* (2006.01)

(52) U.S. Cl. ..... 123/321; 123/90.4; 123/90.22

(58) Field of Classification Search ..... 123/90.16, 123/90.39, 90.4, 90.22, 90.23, 321, 320, 123/323

See application file for complete search history.

(56) References Cited

U.S. PATENT DOCUMENTS

| | | | | |
|---|---|---|---|---|
| 3,977,064 | A | 8/1976 | Mote et al. | |
| 4,161,113 | A | 7/1979 | Kline | |
| 5,626,116 | A | 5/1997 | Reedy et al. | |
| 5,937,807 | A * | 8/1999 | Peters et al. | 123/90.15 |
| 5,992,376 | A * | 11/1999 | Okada et al. | 123/321 |
| 6,234,143 | B1 * | 5/2001 | Bartel et al. | 123/321 |
| 6,293,237 | B1 | 9/2001 | Vorih | |
| 6,386,160 | B1 | 5/2002 | McNeely et al. | |
| 6,805,093 | B2 | 10/2004 | Zsoldos et al. | |
| 2004/0237932 | A1 | 12/2004 | Persson | |
| 2006/0260572 | A1 | 11/2006 | Sugie et al. | |

OTHER PUBLICATIONS

International Search Report for corresponding International Application PCT/US2006/061910.

Supplementary European Search Report for corresponding European App. 06 84 0197.

* cited by examiner

*Primary Examiner* — Thomas Denion
*Assistant Examiner* — Daniel Bernstein
(74) *Attorney, Agent, or Firm* — WRB-IP LLP

(57) ABSTRACT

A valve opening arrangement includes a first contact surface on a first member, and a second contact surface on a second member discrete from the first member. A first and a second opening are provided, and a first and a second valve movable to open and close the first and second opening, respectively, are provided. A yoke is arranged to move the first valve and not the second valve when contacted by the first contact surface and is arranged to move the first valve and the second valve when contacted by the second contact surface.

24 Claims, 4 Drawing Sheets

VALVE OPENING ARRANGEMENT AND METHOD

BACKGROUND AND SUMMARY

The present invention relates generally to a valve opening arrangement and method and, more particularly, to a valve opening arrangement and method including a yoke for moving one or both of two valves.

In many engines today, each cylinder is provided with two intake and two exhaust valves. The valves are often opened by a yoke connected to the two intake or exhaust valves. The yoke is generally forced in one direction to open the valves by a rocker arm and, usually, springs urge the valves to a closed position after the rocker arm force is released. The architecture of many engines places the valve yoke in close proximity to the rocker arm pivot shaft. This creates packaging issues that prevent the use of state of the art single-valve engine brake actuation. It is desirable to actuate only the valve closest to the rocker shaft to better utilize rocker arm mechanical advantage and allow higher cylinder pressures for more braking power. While this might be accomplished with a hydraulic lash adjuster that actuates through the valve yoke on the inboard valve, the proximity of the yoke to the rocker shaft on group engines does not leave any space to include this piston. Thus, the lash adjustment must be made to the entire yoke so that both valves are actuated under braking. This requires lower pressures for the given valve train package.

It is desirable to provide a valve opening arrangement that can provide for flexible valve actuation arrangements while occupying minimal space. It is also desirable to provide such a valve opening arrangement that facilitates both single valve actuation during engine braking and two valve actuation during engine exhaust.

In accordance with an aspect of the present invention, a valve opening arrangement comprises a first contact surface on a first member, a second contact surface on a second member discrete from the first member, a first and a second opening, a first and a second valve movable to open and close the first and second opening, respectively, and a yoke arranged to move the first valve and not the second valve when contacted by the first contact surface and arranged to move the first valve and the second valve when contacted by the second contact surface.

In accordance with another aspect of the present invention, a method of actuating exhaust valves in an engine is provided. The engine comprises at least one cylinder, the cylinder comprising first and second exhaust valves. In the method, a first contact surface on a first member is moved to a first valve open position in which the first contact surface contacts a yoke and thereby moves the first valve and not the second valve to an open position. A second contact surface on a second member is moved to a second valve open position in which the second contact surface contacts the yoke and thereby moves the first valve and the second valve to the open position, the first and second members being discrete from each other.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
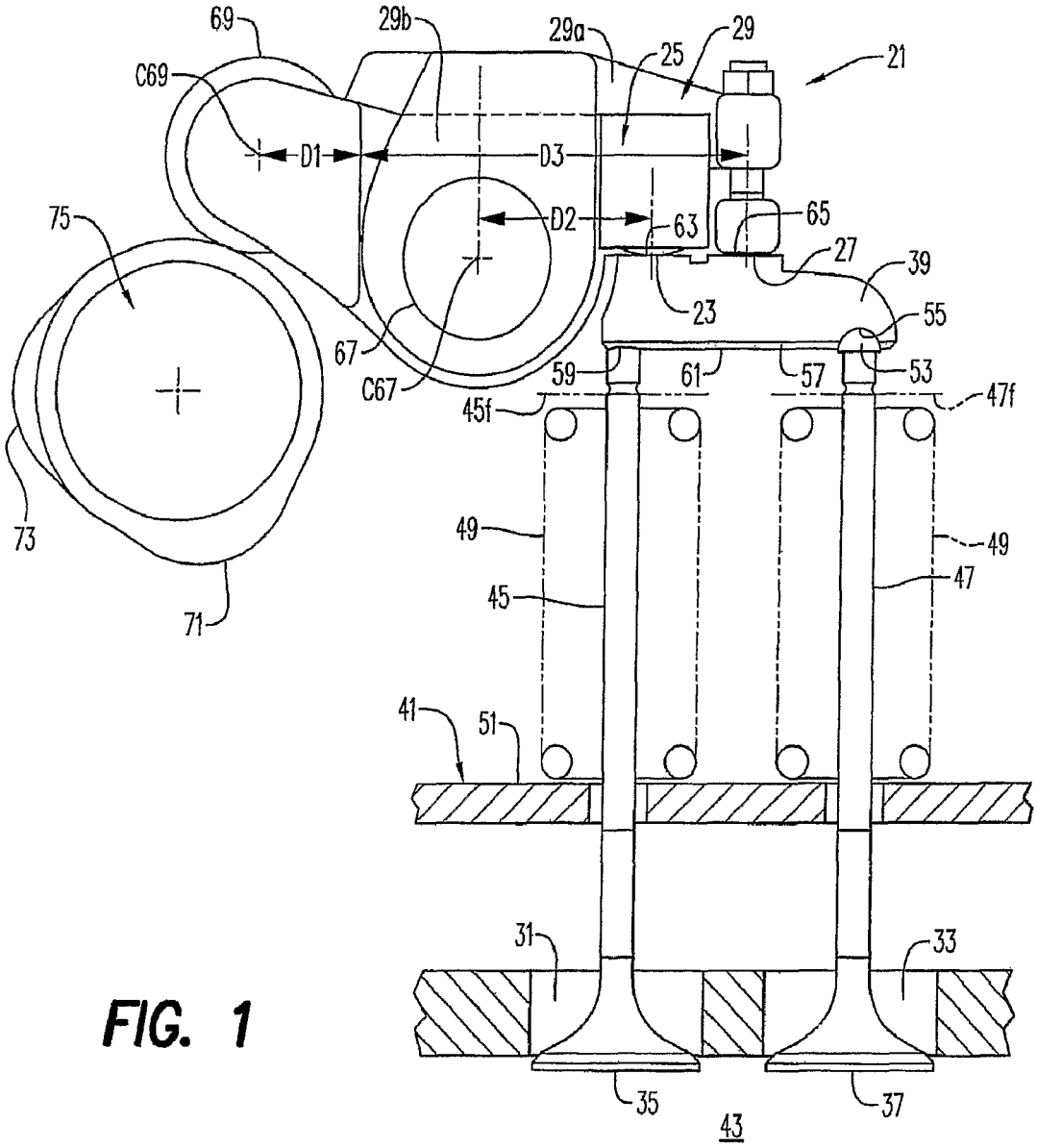
FIG. 1 is a schematic, partially cross-sectional view of a valve opening arrangement according to an embodiment of the present invention in a neutral position.
Figure 2:
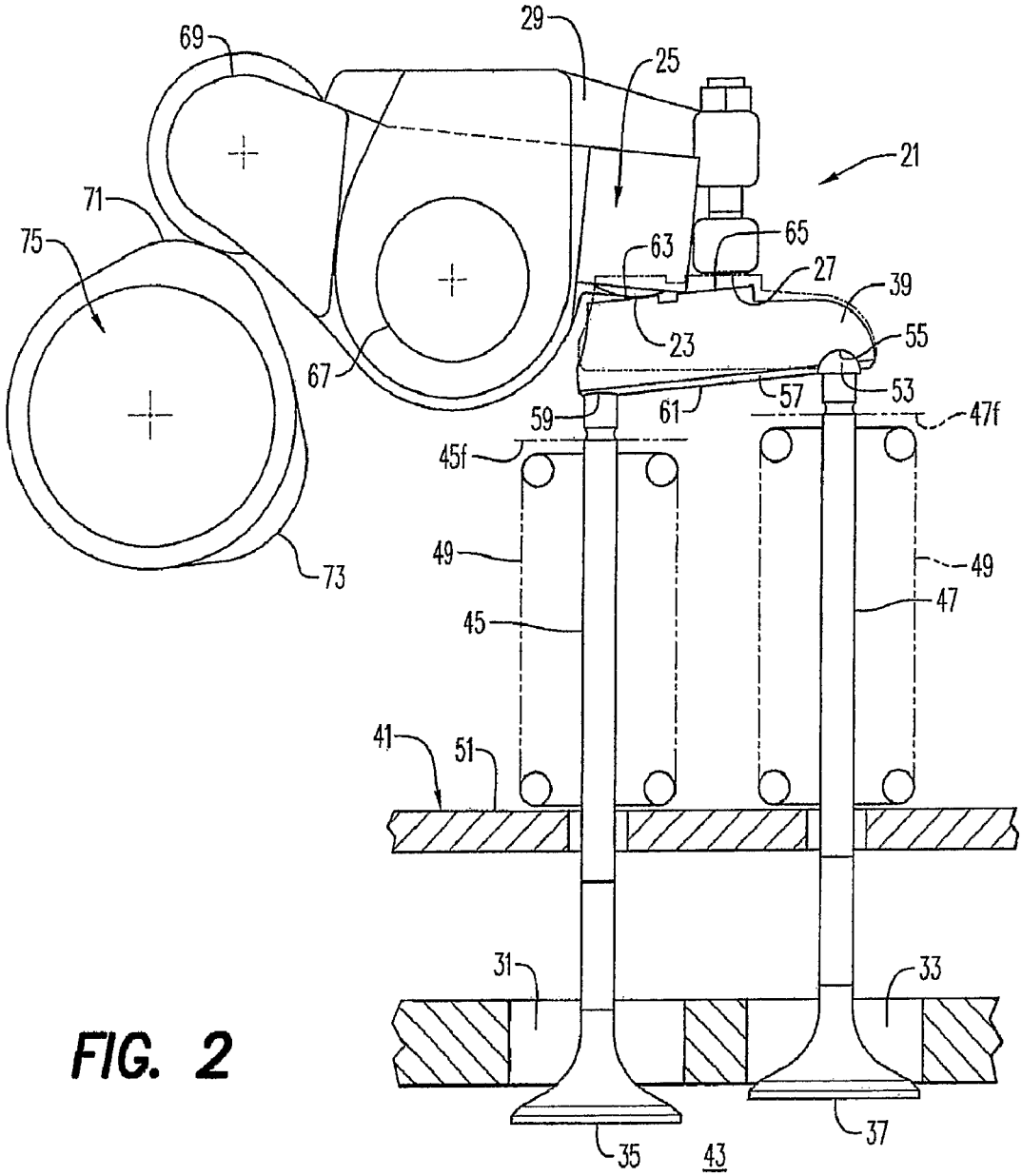
FIG. 2 is a schematic, partially cross-sectional view of a valve opening arrangement according to an embodiment of the present invention in a first open position.
Figure 3:
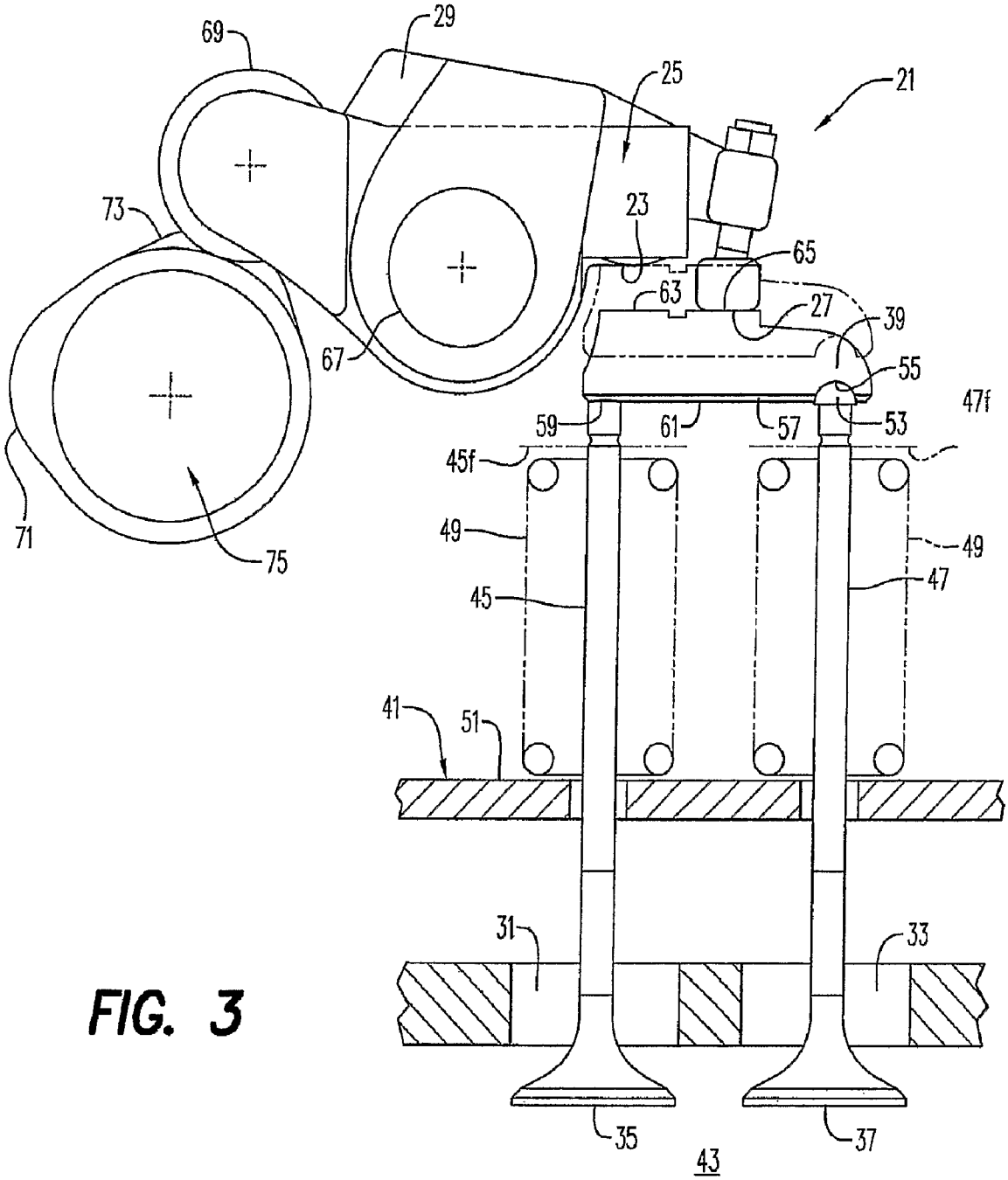
FIG. 3 is a schematic, partially cross-sectional view of a valve opening arrangement according to an embodiment of the present invention in a second open position.

A valve opening arrangement 21 according to an embodiment of the present invention is shown in FIGS. 1-3. The valve opening arrangement 21 comprises a first movable contact surface 23 which, in the illustrated embodiment, is part of a first member, here first rocker arm 25, and a second movable contact surface 27 which, in the illustrated embodiment, is part of a second member, here a second rocker arm 29. The first and second members will ordinarily be discrete from each other. The first and second movable contact surfaces 23 and 27 do not have to be part of rocker arms 25 and 29. They may, for example, form part of reciprocating members such as pistons. An aspect of the present invention includes use of a valve opening arrangement in connection with an engine 41 including one or more cylinders 43, however, the invention is not limited to such uses.

The valve opening arrangement 21 also comprises a first and a second opening 31 and 33, and a first and a second valve 35 and 37 movable to open and close the first and second opening, respectively. A yoke 39 is arranged to move the first valve 35 and not the second valve 37 when contacted by the first movable contact surface 23 as seen in FIG. 2, and is arranged to move the first valve and the second valve when contacted by the second movable contact surface 27 as seen in FIG. 3. The yoke 39 can be arranged to move the first valve 35 and/or the second valve 37 by contacting them directly or, more typically, via contact with first and second valve stems 45 and 47 associated with the first and second valves 35 and 37, respectively. In an embodiment of the present invention involving an engine 41, the first and second openings 31 and 33 and first and second valves 35 and 37 are exhaust valves for a cylinder 43. The yoke 39 is arranged to move the first valve 35 to an open position when the yoke is contacted by the first movable contact surface 23 and is arranged to move the first valve 35 and the second valve 37 to open positions when contacted by the second movable contact surface 27.

Ordinarily, the yoke 39 will be pivotable, i.e., the yoke is not constrained to only vertical movement as is typically the case where a center pin is provided. As seen in FIG. 1, the first and second valves 35 and 37 will ordinarily be spring loaded to a closed position relative to the first and second openings 31 and 33. While the first and second valves 35 and 37 can be urged to a closed position by any suitable means, typically springs 49 will be mounted around the first and second valve stems 45 and 47 and contact, at a bottom of the springs, a surface 51 above the cylinder 43 and, at a top of the springs, flanges **45*f* and 47*f* extending from the first and second valve stems. Thus, when the valve stems 45 and 47 are moved by the yoke 39, the flanges 45*f* and 47*f* compress the springs 49 against the surface 51 above the cylinder 43 so that the first and second valves 35 and 37 are moved from the first and second openings 31 and 33 into the cylinder 43**.

The yoke 39 can contact the top ends of the valve stems 45 and 47. At least the second valve stem 47 will ordinarily have a rounded top 53 that will be received in a correspondingly rounded recess 55 in the bottom surface 57 of the yoke 39. The first valve stem 45 will ordinarily have a less rounded top 59 that will contact the bottom surface 57 of the yoke 39. The top 57 of the first valve stem 45 will ordinarily have some radius or chamfer to facilitate rocking and sliding relative to the yoke 39. A skirt 61 can descend from the yoke 39 on the sides of the tops 53 and 57 and can function together with the rounded top 53 and rounded recess 55 in the second valve stem 47 and the yoke to keep the yoke oriented relative to the valve stems.

When the first movable contact surface 23 contacts the yoke 39, it will ordinarily be arranged to contact the yoke at a first contact point 63 proximate the first valve stem 45 so that, as seen in FIG. 2, the yoke will pivot around the rounded top 53 of the second valve stem 47 and rounded recess 55 in the yoke, i.e., it defines a pivot point or fulcrum. By contacting the yoke 39 at the first contact point 63, the first movable contact surface 23 will apply force primarily to the springs 49 keeping the first valve 35 in the closed position and, thus, will only move the first valve. The second valve 37 will ordinarily not be moved when the first movable contact surface 23 contacts the first contact point 63. When the second movable contact surface 27 contacts the yoke 39 as seen in FIG. 3, it will ordinarily be arranged to contact the yoke, usually at a center contact point 65 proximate a center of the yoke, in such a manner that the yoke does not pivot and the springs 49 associated with both the first valve 35 and the second valve 37 will be compressed to open both valves substantially simultaneously.

The first and second rocker arms 25 and 29 are ordinarily pivotably mounted on a common shaft 67. A centerline C67 of the shaft 67 to a centerline C69 of pushrods or rollers 69 that contact cams 71 and 73 on a camshaft 75 for moving the valves 35 and 37, respectively, is ordinarily the same distance D1 for the first rocker arm 25 and the second rocker arm 29. A distance D2 between the first movable contact surface 23 and the shaft 67 is ordinarily less than the distance D3 between the second movable contact surface 27 and the shaft, i.e., the first movable contact surface is "inboard" of the second movable contact surface, and the rocker ratio D3/D1 is greater than the rocker ratio D2/D1. This arrangement minimizes the force required to be transmitted from the camshaft through the first rocker arm 25 to open the first valve 35 when the first movable contact surface 23 contacts the yoke 39. This arrangement can reduce potentially harmful forces on the camshaft during an engine braking operation as the first rocker arm 25 will ordinarily be pivoted to open the first valve 35 only during the engine braking operation when forces required to open the valves are generally substantially higher than during normal exhaust operation when the second movable contact surface 27 contacts the yoke.

Figure 4:
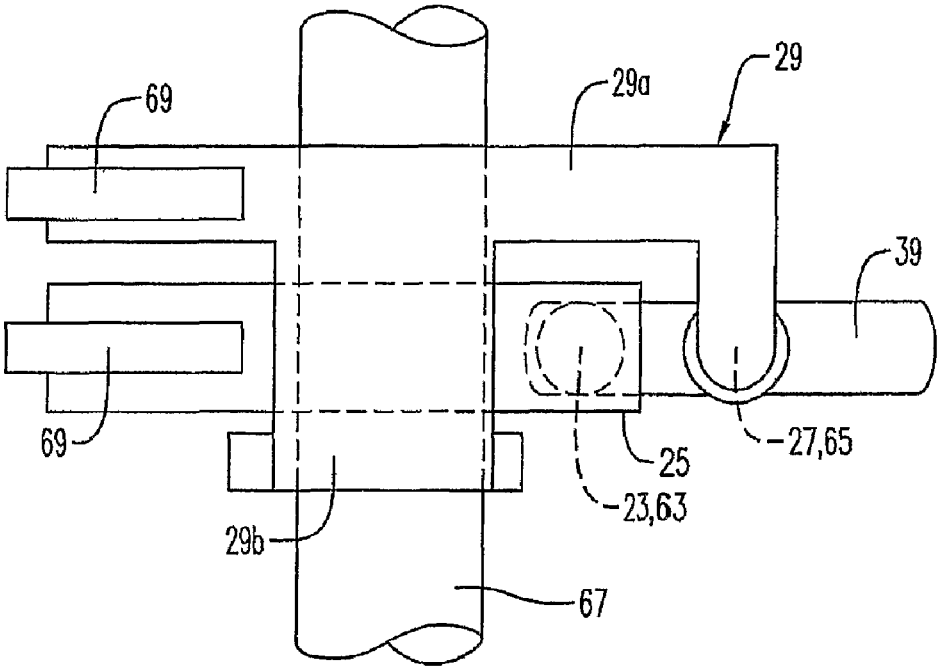
FIG. 4 is a schematic, top view of a valve opening arrangement according to an embodiment of the present invention.

As seen in FIG. 4, the first rocker arm 25 and the second rocker arm 29 can be configured to facilitate contacting first and center contact points 63 and 65 on a yoke 39 that is substantially aligned along a longitudinal axis of the first rocker arm. It will, however, be appreciated that other configurations to permit contact with the first and center contact points on the yoke can be provided, such as by orienting the yoke perpendicular to longitudinal axes of first and second rocker arms. In FIG. 4, it will be seen that the first rocker arm 25 extends in a substantially straight line, when viewed from above, from the shaft 67 on which it is pivotably mounted to the first movable contact surface 23 so that the first movable contact surface is positioned proximate the first contact point 63. An arm 29*a* of the second rocker arm 29 can curve or bend around a forward end of the first rocker arm 25 so that the second movable contact surface 27 is positioned proximate the center contact point 65 on the yoke 39. The second rocker arm 29 can include a second portion 29*b* that extends over part of the first rocker arm 25 and includes an opening through which the shaft 67 can extend. The second portion 29*b* can provide additional stability.

The camshaft 75 will ordinarily be arranged to cause the first rocker arm 25 and the second rocker arm 29 to pivot at different times, e.g., the camshaft will cause the first rocker arm to pivot when the second rocker arm is not pivoted and/or the first rocker arm will pivot at a different frequency than the second rocker arm.

The first movable contact surface 23 can be part of a piston 77 movably disposed in a cylinder 79 provided in the first rocker arm 25. The piston 77 may be controlled to extend to one or more active positions in which the first movable contact surface 23 can contact the first contact point 63 on the yoke 39 when the first rocker arm 25 is pivoted forward, and to retract to an inactive position in which the first movable contact surface cannot contact the first contact point on the yoke, even if the first rocker arm is pivoted forward. The position of the piston 77 can be controlled in a variety of ways.

Figure 5:
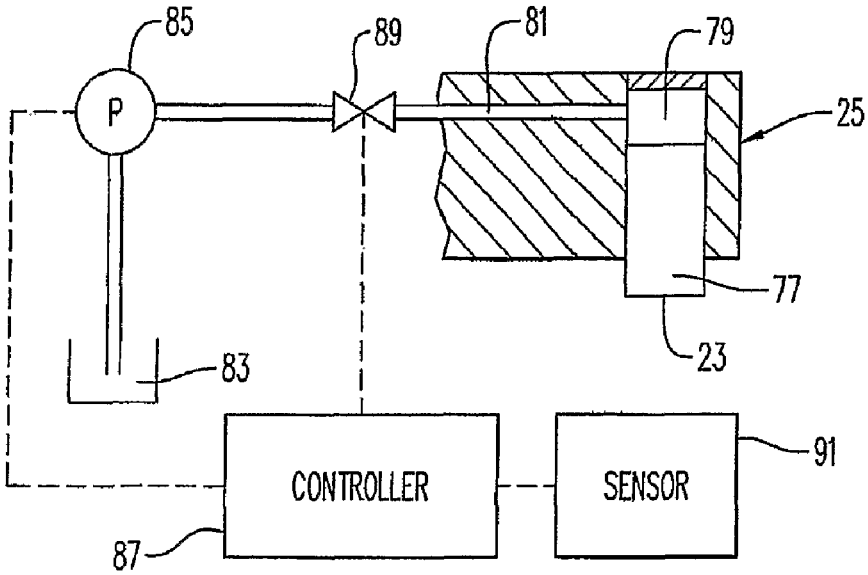
FIG. 5 is a schematic view of a valve opening arrangement according to an embodiment of the present invention.

As seen in FIG. 5, the piston 77 can be driven to an active position by hydraulic pressure in the cylinder 79 provided through a line 81 leading to a suitable source 83 of hydraulic fluid and a pump 85, however, they can be moved by any suitable means, such as by being moved mechanically, pneumatically, or via electrically operated or magnetic means. When hydraulic pressure is relieved or reduced, the piston 77 can be moved to an inactive or retracted position by any suitable means, such as by a spring, such as the spring 49 loading the valve 35 transmitting force to move the piston through the yoke 39. U.S. Pat. No. 5,193,497, U.S. Pat. No. 5,609,133 and U.S. Patent Application Publication No. 2004/0112330 disclose embodiments of rocker arms with extendable pistons, including fluid lines and valves not illustrated here, and are incorporated by reference. The position of the piston 77 can be controlled by, for example, a controller 87 that is provided to send appropriate signals to one or more of a valve 89 in the line 81 and the pump 85 to cause fluid to be pumped to the cylinder 79 to move the first movable contact surface 23 on the piston 77 to an active position. The controller 87 can send such signals when, for example, a signal is received by the controller to perform an engine braking operation. The signal may be sent to the controller 87 from, e.g., a sensor 91 that senses a condition calling for engine braking.

In addition to facilitating engine braking, selective opening and closing of the exhaust valve or valves 35 and/or 37 can facilitate performing functions such as raising the exhaust gas temperature in an engine. Copending International Patent Application No. PCT/US06/61908, filed on the same date as the present application, entitled, VALVE OPENING ARRANGEMENT AND METHOD, naming Mack Trucks, Inc., as applicant, and naming Edward Smith, Chun Tai, and Timothy Suder, as inventors, discloses, e.g., increasing engine exhaust temperature by selective opening and closing of an exhaust valve of a cylinder and is incorporated by reference. According to an aspect of the present invention, the piston 77 is moved outward so the first movable contact surface opens the first valve 35 to achieve desired engine exhaust temperatures.

A method of actuating first and second exhaust valves 35 and 37 in an engine 41 involves an engine comprising at least one cylinder 43, the cylinder 43 comprising the first and second exhaust valves. In the method, as seen in FIG. 2, a first contact surface 23 is moved from a neutral position (FIG. 1) to a first valve open position in which the first contact surface contacts a pivotable yoke 39 and thereby moves the first valve 35 and not the second valve 37 to an open position. The first contact surface 23 can be disposed on a first rocker arm 25 that is pivoted by a cam 71 on a camshaft 75.

As the camshaft 75 continues to rotate, another cam 73 can contact a second rocker arm 29 on which a second contact surface 27 can be disposed, thereby moving the second contact surface to a second valve open position (FIG. 3) in which the second contact surface contacts the pivotable yoke 39 and thereby moves both the first valve 35 and the second valve 37 to the open position. The cams 71 and 73 can be arranged so that the first rocker arm 25 and the second rocker arm 29 pivot at different times and/or different frequencies.

When the first contact surface 23 contacts the pivotable yoke 39, the pivotable yoke can pivot about a pivot point that can be defined by a rounded top 53 of a valve stem 47 for the second valve 37 that is received in a rounded recess 55 in the bottom surface 57 of the pivotable yoke 39. When the second contact surface 27 contacts the pivotable yoke 39, the pivotable yoke will ordinarily not pivot about that pivot point.

The first contact surface 23 can also be part of a piston 77 and movement of the first contact surface to the first valve open position can comprise moving the piston relative to a cylinder 79 in which the piston is movably disposed. The cylinder 79 can be formed in the first rocker arm 25 and can be moved from a retracted, inactive position, to one or more extended active positions in which it can be moved by pivoting the first rocker arm to contact the pivotable yoke 39. The piston 77 can be extended, for example, when it is desired to perform an engine braking operation and retracted when it is desired to cease engine braking. For example, the first rocker arm 25 can pivot under action of the cam 71 and the pivoting action of the first rocker arm may not result in the first contact surface 23 contacting the pivotable yoke 39 until the piston 77 is extended to an active position. By contrast, the regular pivoting of the second rocker arm 29 under action of the cam 73 can always cause the second contact surface 27 to contact the pivotable yoke to move the valves 35 and 37 substantially simultaneously to, for example, permit exhaust to escape from the cylinder 43.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A valve opening arrangement, comprising:

a first contact surface on a first member;

a second contact surface on a second member discrete from the first member;

a first and a second opening;

a first and a second valve movable to open and close the first and second opening, respectively; and a yoke arranged to move the first valve and not the second valve when contacted by the first contact surface and arranged to move the first valve and the second valve when contacted by the second contact surface, wherein the first and second members are first and second rocker arms.

2. The valve opening arrangement as set forth in claim 1, wherein the yoke is arranged to move the first valve to an open position when contacted by the first contact surface and arranged to move the first valve and the second valve to open positions when contacted by the second contact surface.

3. The valve opening arrangement as set forth in claim 2, wherein the yoke is pivotable.

4. The valve opening arrangement as set forth in claim 3, wherein the first contact surface is arranged to contact the yoke proximate a first end of the yoke.

5. The valve opening arrangement as set forth in claim 4, wherein the second contact surface is arranged to contact the yoke proximate a center of the yoke.

6. The valve opening arrangement as set forth in claim 3, wherein the second contact surface is arranged to contact the yoke proximate a center of the yoke.

7. The valve opening arrangement as set forth in claim 3, wherein the yoke contacts first and second valve stems associated with the first and second valves, respectively, at least one of the first and second valve stems having an end defining a pivot point of the yoke.

8. The valve opening arrangement as set forth in claim 1, wherein the yoke is pivotable.

9. The valve opening arrangement as set forth in claim 8, wherein the first contact surface is arranged to contact the yoke proximate a first end of the yoke.

10. The valve opening arrangement as set forth in claim 9, wherein the second contact surface is arranged to contact the yoke proximate a center of the yoke.

11. The valve opening arrangement as set forth in claim 8, wherein the second contact surface is arranged to contact the yoke proximate a center of the yoke.

12. The valve opening arrangement as set forth in claim 8, wherein the yoke contacts first and second valve stems associated with the first and second valves, respectively, at least one of the first and second valve stems having a rounded end defining a pivot point of the yoke.

13. The valve opening arrangement as set forth in claim 1, wherein the first and second rocker arms are pivotably mounted on a common shaft and the first contact surface is disposed closer to the shaft than the second contact surface.

14. The valve opening arrangement as set forth in claim 1, wherein the arrangement comprises a camshaft arranged to cause the first rocker arm and the second rocker arm to pivot at different times.

15. The valve opening arrangement as set forth in claim 14, wherein the camshaft causes the first rocker arm to pivot when the second rocker arm is not pivoted.

16. The valve opening arrangement as set forth in claim 1, wherein the first contact surface is part of a piston movably disposed in a cylinder in the first rocker arm.

17. An engine comprising the valve opening arrangement of claim 1.

18. A method of actuating exhaust valves in an engine, the engine comprising at least one cylinder, the cylinder comprising first and second exhaust valves, comprising:

moving a first contact surface on a first member to a first valve open position in which the first contact surface contacts a yoke and thereby moves the first valve and not the second valve to an open position; and moving a second contact surface on a second member to a second valve open position in which the second contact surface contacts the yoke and thereby moves the first valve and the second valve to the open position, the first and second members being discrete from each other, wherein the first and second members are first and second rocker arms.

19. The method of actuating exhaust valves in an engine as set forth in claim 18, wherein, when the first contact surface contacts the yoke, the yoke pivots about a pivot point.

20. The method of actuating exhaust valves in an engine as set forth in claim 19, wherein, when the second contact surface contacts the yoke, the yoke does not pivot about the pivot point.

21. The method of actuating exhaust valves in an engine as set forth in claim 18, wherein the first contact surface is part of a piston and movement of the first contact surface to the first valve open position comprises moving the piston relative to a cylinder in which the piston is movably disposed.

22. The method of actuating exhaust valves in an engine as set forth in claim 18, wherein the first and second members are first and second rocker arms pivotably mounted on a common shaft, the method comprising pivoting the first and second rocker arms at different times.

23. The method of actuating exhaust valves in an engine as set forth in claim 18, wherein the first and second rocker arms are pivotably mounted on a common shaft and the first contact surface is disposed closer to the shaft than the second contact surface.

24. The method of actuating exhaust valves in an engine as set forth in claim 18, comprising moving the first valve and not the second valve to an open position during an engine braking operation and moving the first valve and the second valve to the open position during an exhaust operation.

* * * * *